United States Patent [19]

Irvine

[11] Patent Number: 4,772,519

[45] Date of Patent: Sep. 20, 1988

[54] DISTANCE PIECE

[75] Inventor: John Irvine, Sacramento, Calif.

[73] Assignee: J. Irvine, Inc., Sacramento, Calif.

[21] Appl. No.: 841,181

[22] Filed: Mar. 19, 1986

[51] Int. Cl.[4] ..... A63H 33/08

[52] U.S. Cl. ..... 428/542.8; 160/39; 248/261

[58] Field of Search ..... 160/38–39; 248/251, 261, 266, 916; 446/117, 128, 123; 428/133, 542.8

[56] References Cited

U.S. PATENT DOCUMENTS

| | | | |
|---|---|---|---|
| 3,094,792 | 6/1963 | Morgan et al. | 446/117 X |
| 3,717,948 | 2/1973 | Schnabel | 446/128 |
| 4,129,960 | 12/1978 | Gale | 446/128 |
| 4,254,813 | 3/1981 | Vecchiarelli | 160/39 X |
| 4,384,605 | 5/1983 | Schaeffer et al. | 160/38 |
| 4,562,982 | 1/1986 | McSherry et al. | 248/61 |

FOREIGN PATENT DOCUMENTS

| | | | |
|---|---|---|---|
| 2115687 | 9/1983 | United Kingdom | 248/261 |

*Primary Examiner*—Henry F. Epstein
*Attorney, Agent, or Firm*—Ladas & Parry

[57] ABSTRACT

Distance piece for mounting an object at a distance from a wall, the piece being formed by a block-shaped body with a flat rear side, and a front side extending substantially parallel to the rear side. The front side is provided with a protruding part and with at least one pair of bore holes extending perpendicularly to the rear side and through the body.

17 Claims, 3 Drawing Sheets

DISTANCE PIECE

The present invention relates to a distance piece.

When suspending objects, such as curtains, Venetian blinds and the like which usually have to be suspended at a certain distance from a wall or the like it frequently happens that the supporting elements supplied are to short to realise the desired manner of suspension. Although there are extension pieces on the market they usually are relatively long and look unattractive.

The invention now provides a distance piece formed by a body with a flat rear side and a front side extending substantially parallel to the rear side, said front side being provided with a protruding part and with at least one pair of bore holes extending perpendicularly to the rear side and through the body. Such a distance piece can be made to look simple and unobtrusive and can be mounted inconspicuously between an object to be suspended and a wall or similar supporting element whilst, if necessary, the length of the distance piece can easily be extended by means of an extension piece according to the invention having at its rear end a recess into which the protruding part of the distance piece fits with a tight fit, whilst the distance piece is provided with at least two passages, which, when the extension piece is mounted on the distance piece, are in alignment with the holes provided in the distance piece.

Both the distance piece and the extension pieces can be constructed with a comparatively small height, whilst by combining a distance piece with one or more extension pieces any desired distance can be filled.

BRIEF DESCRIPTION OF THE DRAWINGS

The invention will be more fully explained hereinafter with reference to some embodiments of the construction according to the invention illustrated in the accompanying figures.

Figure 1:
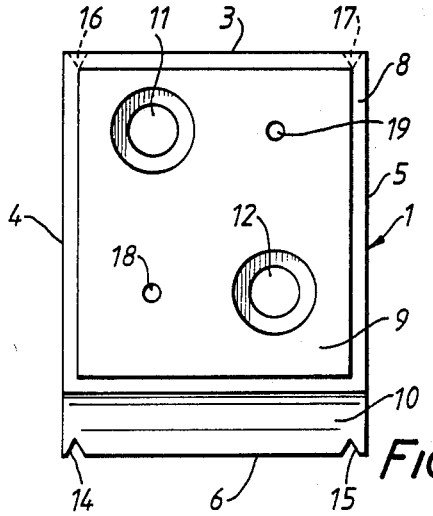
FIG. 1 is a front view of a first embodiment of a distance piece according to the invention.
Figure 2:
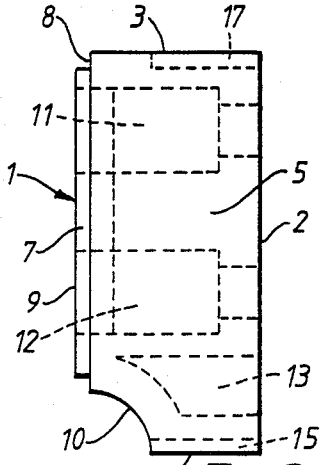
FIG. 2 is a side view of FIG. 1.
Figure 3:
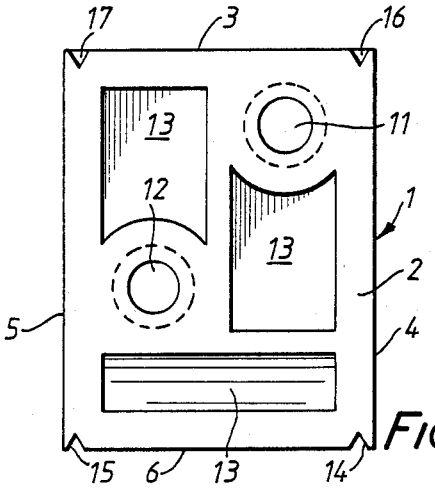
FIG. 3 is a rear view of FIG. 1.

The distance piece 1 illustrated in FIGS. 1–3 is preferably made of plastic material, whereby the distance piece has a substantially rectangular configuration with a flat rear side 2 and side walls 3–6 extending perpendicularly to said rear side.

At its front side the distance piece is provided with a protruding part 7, also having a rectangular shape with smaller dimensions than the dimensions of the rear side 2,so that around the protruding part 7 a recess 8 has been formed. The front face 9 of the protruding part 7 forming the front side of the distance piece extends parallel to the flat rear side 2 of the distance piece.

As further appears in particular from FIG. 2 the side wall 6 has been constructed lower than the side walls 3–5 and the upper edge of the side face 6 joins, via a boundary plane 10 having a curved extension, an outer boundary edge of the recess 8.

In the body of the distance piece there have been provided continuous holes 11 and 12, having a stepped bore, such that the part of the bore joining the front face 9 has a larger diameter than the part of the bore joining the rear face 2.

In order to decrease the quantity of plastic material which is used and to avoid undesired stresses when the distance piece is produced recesses 13 have been provided in the body of the distance piece in the rear side of the distance piece between the parts of the distance piece accommodating the holes 11 and 12.

Near the ends of the side wall 6 grooves 14 and 15, having a V-shaped section and extending parallel to the bore holes 11 and 12, have been provided in the side wall. In a similar manner similar grooves 16 and 17 have been provided in the side face 3 located opposite the side face 6, said grooves extending parallel to the grooves 14 and 15 from the rear face 2 of the distance piece 1 along a distance equal to the length of said grooves 14 and 15, or all the length of face 3.

As further appears from FIG. 1 a pair of dimples 18 and 19, having a circular section, have further been provided to the front face of the distance piece 1, the centre points of said dimples being located in the corner points of a square with the centre points of the passages 11 and 12, such that the centre points of the dimples 18 and 19 as well as the centre lines of the bore holes 11 and 12 are located on a diagonal.

It will be apparent that such a distance piece can be fixed to a wall, ceiling or similar support in a simple manner with appropriate fixing means, such as screws or the like, which are led through the holes 11 and 12, whereby the heads of such screws or bolts may be accomodated countersunk in the parts of the passages 11 and 12 having a larger diameter, so that said heads do not protrude from the distance piece. Then e.g. a support for a curtain, venetian blinds or the like may be fixed to the distance piece by means of further fixing elements, e.g. self-tapping screws, which may drill through the distance piece on the spot of the dimples 18 and 19 and be secured in the distance piece. Also it is possible to lead the fixing elements through the distance piece on the spot of the dimples 18 and 19 and secure them in the wall, ceiling or the like behind which the distance piece has been fixed.

Also it is possible to fix said support and the distance piece to a wall, ceiling or the like with fixing bolts or screws led through both the suitable openings in the support and the openings 11 and 12 and possibly also through the distance piece at the dimples 18 and 19.

Figure 7:
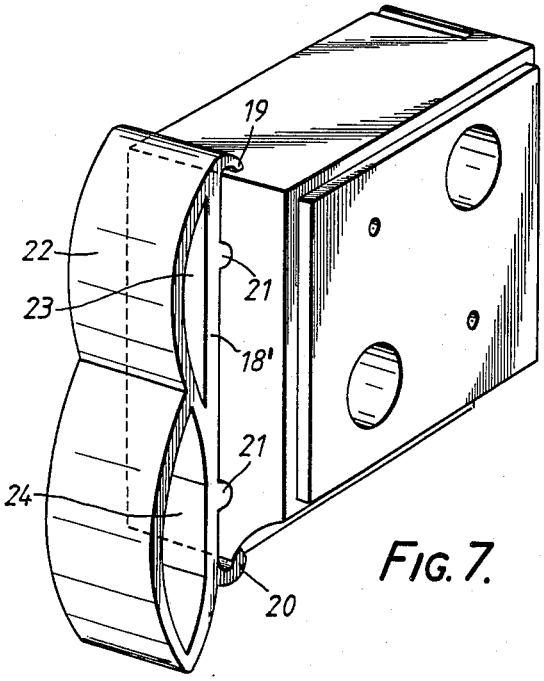
FIG. 7 shows in perspective a combination of a distance piece according to FIGS. 1–3 to which a coupling element has been coupled.
Figure 8:
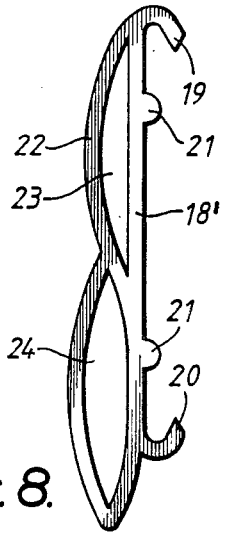
FIG. 8 is a side view of the coupling element illustrated in FIG. 7.

As is illustrated in FIG. 7 the grooves 14–17 formed in the side faces 3 and 6 of the distance piece located opposite each other may be used for coupling thereto a coupling element preferably made of plastic material, which in the illustrated embodiment is provided with a back piece 18' to the ends of which bent hook shaped lips 19 and 20 have been fixed. Furthermore distance cams 21 have been fixed to the back piece 18' at a distance from the hook shaped lips 19 and 20.

As is illustrated in FIG. 7 the ends of the lips 19 and 20 can be slid into opposite grooves for coupling the coupling element to the distance piece. The distance cams 21 prevent thereby that the back piece 18' can be pushed too far into the direction of the distance piece. Preferably at least the hook shaped lips 19 and 20 are flexible, so that the lips can be hooked into the grooves also when the distance piece has already been mounted on its place in a building or the like.

In the illustrated embodiment the coupling element is provided with curved wall parts 22, defining with the back piece 18' the openings 23 and 24 for hooking objects thereto, e.g. fastening a valence, so 22 is actually a valence return holder.

In practice it has appeared that a suitable height of the distance piece, i.e. the distance between the rear face 2 and the front face 9 amounts to $\frac{3}{4}$ inch. the width of the side faces 3 and 6 may thereby be $1\frac{5}{8}$ inches effectively, whilst the width of the side faces 4 and 5 may amount to $1\frac{5}{8}$ inches. When using said dimensions the rear face forms a suitable surface for obtaining an adequate support of the distance piece on the base.

Figure 4:
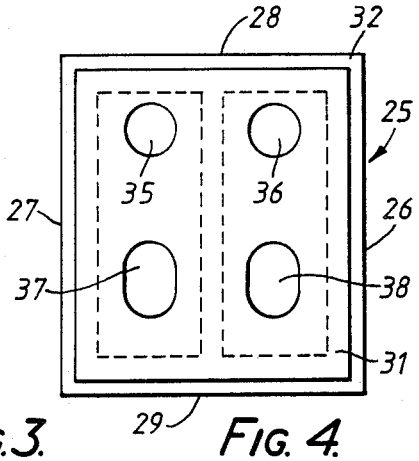
FIG. 4 is a front view of an extension piece to be combined with the distance piece according to FIGS. 1–3.
Figure 5:
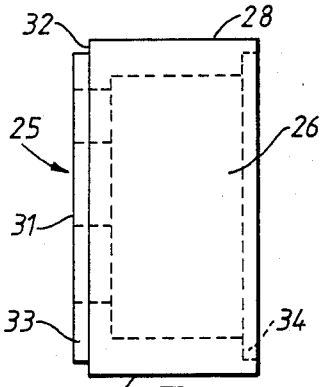
FIG. 5 is a side view of FIG. 4.
Figure 6:
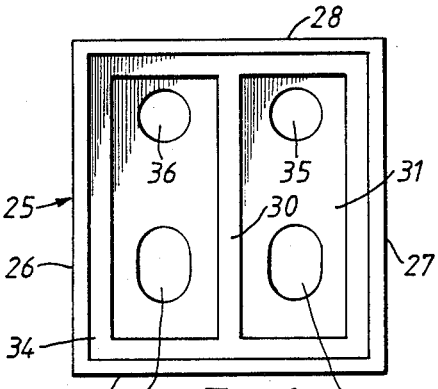
FIG. 6 is a rear view of FIG. 4.

FIGS. 4–6 illustrate an extension piece which may be used effectively in combination with the distance piece discussed hereinabove and illustrated in FIGS. 1–3.

The extension piece 25 also has a rectangular shape and has four walls 26–29 located perpendicular to each other, whereby the centres of the opposite walls 28 and 29 are mutually connected by means of a dividing wall extending parallel to the walls 26 and 27. Provided to an end of the walls 26–30 is a front wall 31 forming a unit with said walls. In the outer circumference of said front wall 31 a circular recess 32 has been formed such that the front wall of the extension piece is provided with a protruding part 33, corresponding in shape with the protruding part of the distance piece 7.

Figure 9:
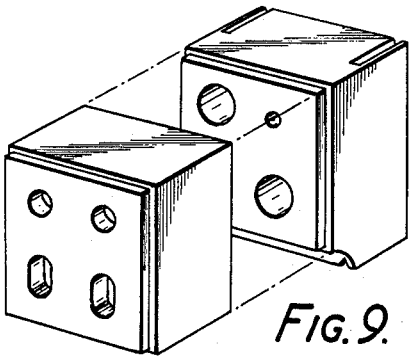
FIG. 9 shows in perspective a distance piece with an extension piece at some distance with respect to each other.

As further appears in particular from FIGS. 5 and 6 a recess 34 has been formed in the facing free edges of the circumferential walls 26–29. The configuration of said recess 34 is thereby such that a protruding part 7 of a distance piece or a protruding part 33 of a further extension piece fits therein with a certain tight fit. The construction is thereby such that, as will be apparent particularly from FIG. 9, the side faces of the distance piece and the extension piece(s) will be located in line with each other when said parts are connected together in the manner described.

In the front wall 31 of the distance piece there have further been provided a pair of circular holes 35 and 36 and a pair of slotted holes 37 and 38 the centre lines of which will be in alignment with the centre lines of the holes 11 and 12 and the dimples 18 and 19 when the extension piece 25 is mounted on a distance piece 1.

Also the height of an extension piece 25, i.e. the distance between the free ends of the boundary walls 26–29 and the front face of the protruding part 33, preferably amounts to $\frac{3}{4}$ inch.

It will be apparent that by possibly combining a distance piece with one or more extension pieces any desired distance between an object to be supported and a support, such as e.g. a wall can be bridged, whereby the distance to be bridged can be adjusted with small steps.

It will be obvious that variations and/or additions to the construction described hereinabove will be possible.

Figure 10:
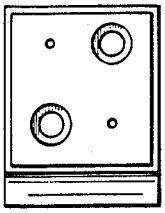
FIG. 10 is a front view of a distance piece constructed in mirror image relative to the distance piece illustrated in FIG. 1.
Figure 14:
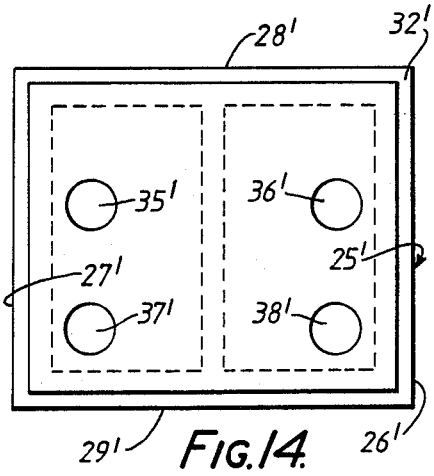
FIG. 14 shows an extension piece matching the distance piece according to FIGS. 11–13.

Thus FIG. 10 shows a construction in mirror image of the distance piece illustrated in FIG. 14.

Figure 11:
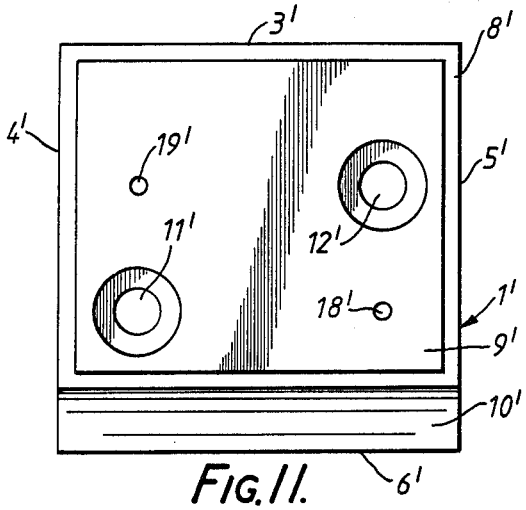
FIG. 11 is a front view of a second embodiment of a distance piece according to the invention.
Figure 12:
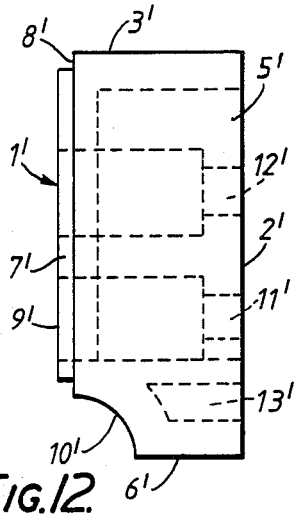
FIG. 12 is a side view of FIG. 11.
Figure 13:
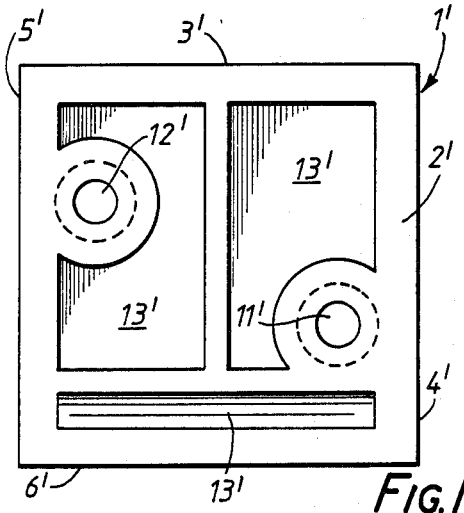
FIG. 13 is a rear view of FIG. 11.

Thus FIGS. 11–13 illustrate a distance piece whose construction is in principle identical to that of the distance piece illustrated in FIGS. 1–3. Corresponding parts are therefore provided with the same reference numbers with the addition of an accent mark.

The difference with the distance piece illustrated in FIGS. 1–3 is that here the length of the sides 3' and 6' is greater than the length of the sides 3 and 6 in the embodiment according to FIGS. 1–3, so that a larger bearing surface for the distance piece has been obtained.

Figure 15:
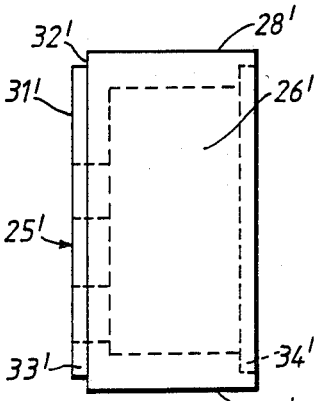
FIG. 15 is a side view of FIG. 14.
Figure 16:
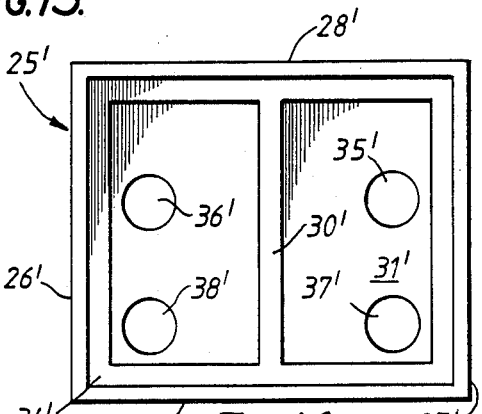
FIG. 16 is a rear view of FIG. 14.

The dimensions of an extension piece to be combined herewith are to be adjusted to the dimensions of the distance piece, as will be apparent from FIGS. 14–16, which illustrate an extension piece to be used in combination with the distance piece according to FIGS. 11–13. The construction of said extension piece is essentially identical to the construction of the extension piece according to FIGS. 4–6 and therefore corresponding parts are provided with the same reference numbers with the addition of an accent mark. As further appears from said figures circular holes 37' and 38' may also be used instead of the longitudinal holes 37 and 38 used in the embodiment according to FIGS. 4–6, depending on the requirements which are made.

The front face 9, front wall 31 and, if so desired, the rear face 2 may be roughed or have a so called textured face to assure a tight fit of any bracket,which would be mounted onto the distance piece or extension piece.

I claim:

1. A distance piece comprised of:

a body having a flat rear portion, a front spaced from said rear portion, and sides connecting said front to said rear portion, said front including a raised surface, said raised surface defining in its surface two openings, said two openings each having a first diameter and extending toward said rear portion, said rear portion having two openings colinear of said two openings defined in said raised surface, and each having a second diameter smaller than said first diameter such that the joinder between said openings defined in said raised surface and said openings defined in said rear portion form a step therebetween.

2. The distance piece of claim 1, wherein said two openings are arranged at a diagonal with respect to each other.

3. The distance piece of claim 2 further including two indentations in said raised surface, said indentations being arranged at a diagonal with respect to each other such that said two indentations and said two raised surface openings form the four corners of a quadrilateral.

4. The distance piece of claim 1 wherein said front includes a bottom and a top opposite said bottom.

5. The distance piece of claim 4 wherein said bottom has at least two grooves therein, said grooves extending between said front and said rear portion.

6. The distance piece of claim 5 wherein said top includes a top surface having two grooves therein, said grooves in said top surface extending between said front and said rear portion.

7. The distance piece of claim 5 wherein said grooves are "V" shaped, the vertex of said "V" pointing toward said raised surface.

8. The distance piece of claim 6 wherein said grooves are "V" shaped, the vertex of said "V" pointing opposite of said top of said rear portion.

9. The distance piece of claim 1. wherein said distance piece is a quadrilateral having flat faces.

10. The distance piece of claim 1, further including an extension piece, said extension piece being generally hollow and compris ing a back; a front; and sides connecting said back and front, said back defining an opening in its surface, said opening corresponding in shape to said raised surface of said distance piece such that said raised surface may be inserted in said opening and securely held therein, said front defining a protrusion on its surface, said protrusion corresponding in shape to said raised surface of said distance piece such that said protrusion fits securely into said opening defined in said back of an extension piece, said protrusion defining on its surface a number of openings, at least some of said openings lying colinear of said two openings defined in said body such that upon placement of said extension piece on said raised surface of said body at least some openings defined on said protrusion communicate with said two openings on said raised surface.

11. The distance piece of claim 10 wherein said extension piece is quadrilateral in shape and greater in size than said raises surface of said distance piece.

12. The distance piece of claim 1 wherein the surface of said raised surface is rough.

13. The distance piece of claim 10 wherein the surface of said protrusion is rough .

14. The distance piece as claimed in claim 5 further including a looped member, said looped member including at least one loop and two ends connected to said loop, said two ends being formed to correspond in shape to said grooves such that said loop may be fastened in said grooves.

15. The distance piece of claim 3 wherein said rear surface defines recesses in its surface directly opposite said indentations.

16. The distance piece of claim 4 wherein said bottom and said rear portion are connected by a "C" shaped surface and wherein said rear portion includes a recess opposite said "C" shaped surface.

17. The distance piece of claim 1, wherein said raised surface is a quadrilateral.

* * * * *